United States Patent [19]

Okumura

[11] Patent Number: 4,788,743

[45] Date of Patent: Dec. 6, 1988

[54] DOOR CHECK FOR AUTOMOBILES

[75] Inventor: Junji Okumura, Toyota, Japan

[73] Assignee: Aisin Seiki Kabushiki Kaisha, Japan

[21] Appl. No.: 100,306

[22] Filed: Sep. 23, 1987

[30] Foreign Application Priority Data

Sep. 30, 1986 [JP] Japan ..... 61-150545

[51] Int. Cl.[4] ..... E05C 17/28

[52] U.S. Cl. ..... 16/82; 16/337; 16/347

[58] Field of Search ..... 16/82, 85, 86 A, 86 B, 16/86 C, 86 R, 332, 337, 341, 344, 345, 347

[56] References Cited

U.S. PATENT DOCUMENTS 2,043,976 6/1936 Schonitzer ..... 16/86 C
2,268,942 1/1942 Jacobs ..... 16/85
2,291,412 7/1942 Schonitzer ..... 16/86 C
2,321,409 6/1943 Moore ..... 16/85
2,882,548 4/1959 Roethel ..... 16/86 C

FOREIGN PATENT DOCUMENTS 60-43586 3/1985 Japan .

*Primary Examiner*—Nicholas P. Godici
*Assistant Examiner*—J. Reed Batten, Jr.
*Attorney, Agent, or Firm*—Finnegan, Henderson, Farabow, Garrett & Dunner

[57] ABSTRACT

A door check for holding a vehicle door to any desired open position relative to the vehicle body includes a lever connected to the vehicle body, a casing connected to the door and receiving a roller holder for relative movement between the door and the vehicle body. The roller holder has a hollow portion for giving resiliency to the holder for eliminating the noises caused by the gap otherwise provided between the two.

3 Claims, 3 Drawing Sheets

DOOR CHECK FOR AUTOMOBILES

BACKGROUND OF THE INVENTION

1. Field of the Invention

This invention relates to a door check for automobiles and more particularly to a door check which holds the door to desired open positions relative to vehicle body.

2. Statement of Prior Art

A door check used for vehicle door is disclosed in a Japanese Patent Publication No. 60-43586 published on Mar. 8, 1985. This prior art check device includes a casing attached to the vehicle door, a roller holder accommodated in the casing and a base member secured to the casing and serving as a cover therefor. Lever attached to the vehicle body is inserted into the casing to be in contact with rollers disposed in the casing and held by the holder. The rollers are slidably moved on the sides of the lever upon door opening and closing. The lever has some detent portions in which the rollers are received for holding the door to any desired positions relative to the vehicle body. According to this conventional structure, some gap or space may be provided between the roller holder and the casing in the lever longitudinal direction. Such gap may cause the casing or base member to generate undesired noises when the rollers are moved on the lever upon door opening or closing operation. Such noises may lead to uncomfortable noises which may be generated within the door as a resonant phenomenon.

SUMMARY OF THE INVENTION

It is therefore, an object of the present invention to obviate the above conventional drawbacks.

It is a further object of the present invention to provide a door check which would not generate any undesired noises upon door opening or closing operation.

It is still another object of the present invention to provide an improved door check which has no clearance between the roller holder and casing which accommodates the roller holder to eliminate vibratory noises.

According to the invention, the above objects will be attained by providing a door check which includes a casing, a roller holder having a roller therein to be in contact with a lever secured to the vehicle body the holder having a hollow portion at one side of the lever longitudinal direction and a resilient portion at the same side to be fittedly accommodated in the casing to eliminate the gap therebetween not to generate any undesired noises.

BRIEF DESCRIPTION OF THE DRAWING

These and further objects of the invention will be more apparent with reference of the attached drawings in which.

DETAILED DESCRIPTION OF THE INVENTION

Figure 1:
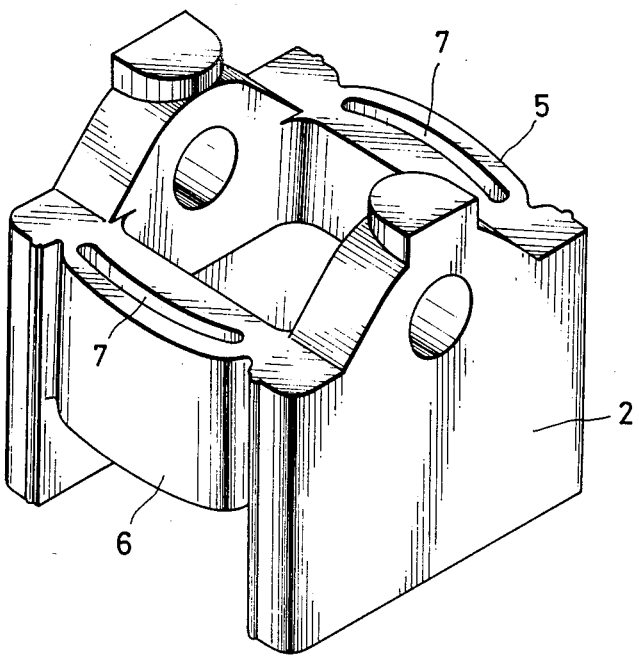
FIG. 1 shows a perspective view of the roller holder according to the present invention.
Figure 2:
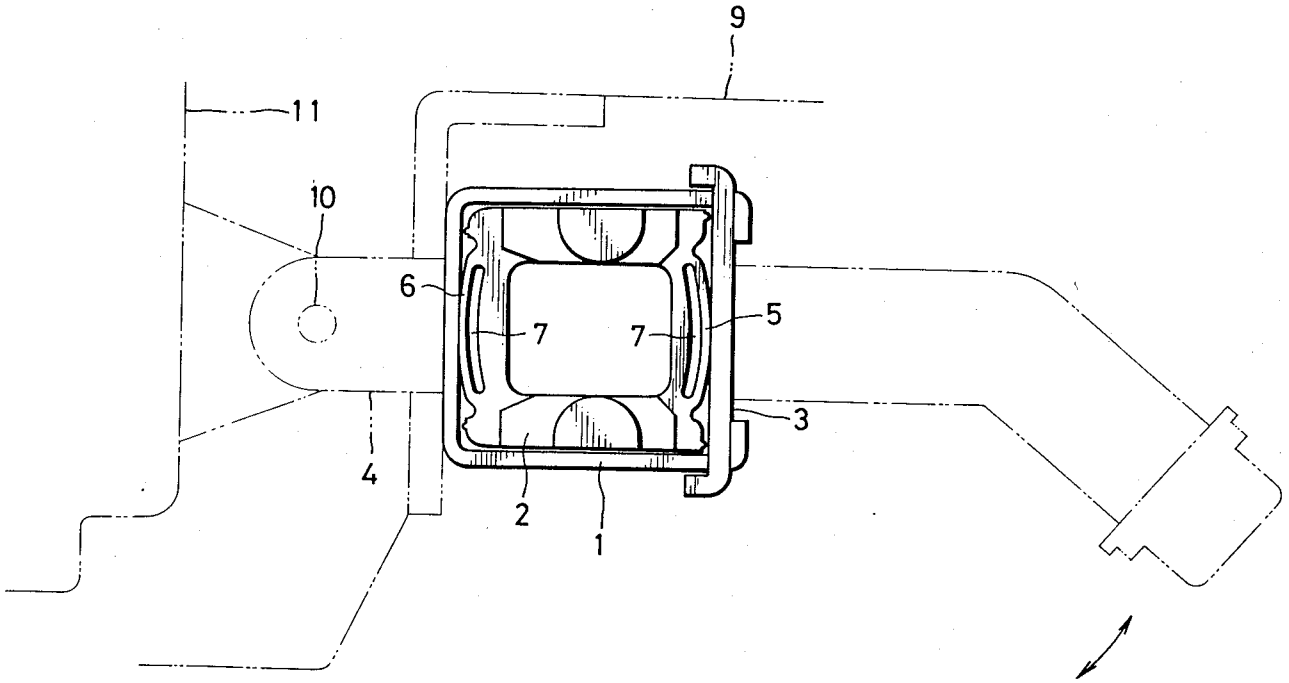
FIG. 2 is a plane view of the roller holder and the casing assembled.

Referring first to FIGS. 1 and 2, numeral 1 designates a casing for accommodating a roller holder 2 therein.

Figure 3:
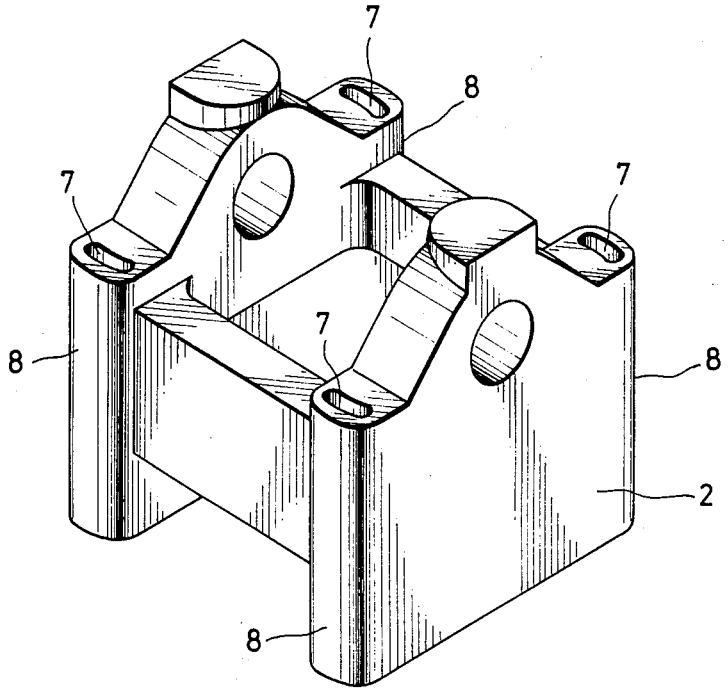
FIG. 3 is a similar view to FIG. 1 but showing another embodiment.

The casing 1 is to be secured to a vehicle door 9 to be swung around hinge portion 10 between the door 9 and vehicle body 11 relative to the latter. The roller holder 2 includes a pair of slots or hollow portions 7,7 provided at opposed sides 5,6. Lever 4 is to be inserted through the holder 2 in the direction of the opposed sides 5,6 of the holder as is shown in FIG. 2. The hollow portions 7 are provided extending in the direction crossing the lever 4. In other words, the hollow portions at the opposed sides extend vertically as shown particularly in FIG. 2 while the lever 4 is inserted into the holder and extends horizontally in FIG. 2. The outer portions of the hollow portions 7 form the resilient portions which can be deformed when the holder 2 is inserted into the casing 1 as shown in FIG. 2. The resilient portions are deformed inwardly when inserted and any gap between a cover member 3 which is secured to the casing 1 and one of the opposed sides of the holder 2 (portion 5) and one side of the casing 1 and the one side of the opposed sides of the holder 2 (portion 6). The deformation of the sides 5,6 can be obtained by the squeezing of the hollow portions 7 provided next thereto. Rollers are not shown but are to be provided in the holder 2 to be rotatably movable on the lever 4 which passes through the holder 2. The holder 2 is made of plastic material. When the door 9 is opened or closed, the casing 1 and, the holder 2 are moved on the lever 4 as indicated by the arrow in FIG. 2. The movement will be carried out smoothly because of the resilient deformation at the opposed sides 5, 6 of the holder 2 against the casing. FIG. 3 shows another embodiment in which each corner of the roller holder 2 is provided a hollow portion 7 and accordingly four resilient portions 8 are formed to absorb the gap between the casing 1 and the holder 2 upon door opening and closing operation. This embodiment has four hollow portions 7 but it may be changed to two - one at front and the other at rear depending on the weight and other conditions of the vehicle door. Obviously many modifications and variations of the invention are possible in light of the above teachings. It is, therefore, to be understood that within the scope of the appended claims, the invention may be practiced otherwise than as specifically described herein.

What is claimed is:

1. A door check for automobiles comprising;

a lever means one end thereof to be secured to a vehicle body;

a casing to be secured to a vehicle door to be rotatable therewith with respect to the vehicle body;

a roller holder accommodated in the casing and having roller means therein to be in contact with and relatively movable with the lever means; and the roller holder further including a hollow portion at one side thereof, the hollow portion extending in the direction crossing the lever longitudinal direction, whereby the hollow portion serves to have resilient force between the casing and the roller holder upon door opening or closing operation.

2. A door check of claim 1 further including a further hollow portion at the other side of the roller holder extending in the direction crossing or transverse to the lever longitudinal direction.

3. A door check of claim 1 wherein the hollow portion is provided at each corner of the roller holder for resiliently inserted into the casing to eliminate any gap therebetween.

* * * * *